United States Patent [19]

Freshcorn

[11] 4,055,472

[45] Oct. 25, 1977

[54] METHOD OF PREPARING NICKEL ALLOY PARTS FOR PLATING

[75] Inventor: Ivan Gene Freshcorn, Kenton, Ohio

[73] Assignee: United Aircraft Products, Inc., Dayton, Ohio

[21] Appl. No.: 723,319

[22] Filed: Sept. 15, 1976

[51] Int. Cl.[2] ..... C25D 5/40

[52] U.S. Cl. ..... 204/32 R

[58] Field of Search ..... 204/32; 427/309

[56] References Cited

U.S. PATENT DOCUMENTS

| | | | |
|---|---|---|---|
| 3,700,482 | 10/1972 | Jacky | 204/32 R |
| 3,838,022 | 9/1974 | Bartolini | 204/32 R |
| 3,878,065 | 4/1975 | Carr | 204/32 R |

*Primary Examiner*—G. L. Kaplan
*Assistant Examiner*—William T. Leader
*Attorney, Agent, or Firm*—J. E. Beringer

[57] ABSTRACT

A plating preparation method in which a nickel part is placed in an electrolyte bath of such acid concentration and such temperature as to promote thorough etching of the part surface and in which an etched part is allowed to soak in the same electrolyte bath for a period of time sufficient to dissolve formed metallic oxides. A coating of a base material is applied to the part following removal from the etching bath, the base material achieving a close intimate contact with the part surface and penetrating and interlocking with recessed areas of such surface.

7 Claims, No Drawings

METHOD OF PREPARING NICKEL ALLOY PARTS FOR PLATING

BACKGROUND OF THE INVENTION

Some industrial or technological parts desirably combine an essentially hard, wear resistant property with a superficially more ductile surface. For example, metallic sealing rings are sometimes made of a nickel alloy, containing a high proportion of a substantially pure nickel, in order that in use they may exhibit desired strength, wear and corrosion resistance characteristics. In some instances, however, these devices function best when they are superficially more ductile and therefore better able to adapt to imperfections in sealing surfaces between which they may be positioned. It has been a practice, therefore, to apply to a formed nickel alloy sealing ring a plating of another and softer material, for example a silver alloy. Electroplating techniques by which this may be done are known and available. Their use, however, has had inconsistent results in that the applied material is not always uniformly adherent to the parent metal. Also, efforts to machine a plated ring frequently have the effect of causing the plate material to peel or to crack, making the ring unfit for use. Non-uniformity in the applied plating has led to time consuming inspection procedures and expensive scrapping of material. Necessary machining of a sealing ring has been done prior to plating, even though this involves special handling and fixturing of the ring during plating.

In considering the problems involved in producing plated nickel alloy parts, particularly as they relate to sealing rings, I have become aware that known procedures aimed at removing nickel oxides from the part surface are not entirely successful. The presence of these oxides has an inhibiting effect on the security of the bond established with the plating material and acts still further to limit the extent to which an immediately adjacent layer of applied material may interlock with the part surface, even when that surface is etched before plating. The oxides exist as a loosely adherent layer on the part surface and even though they may revert to the metallic state during the plating process cannot return as an integral part of the parent material. With these conditions in mind, I devised a method of preparing nickel alloy parts for plating which insures that the part surface is thoroughly etched and free of nickel oxides. Putting such method into practice, plated sealing rings now are produced in which a sound, uniform bond exists between the plating material and the parent metal, and which can be machined after plating. Cost and reliability factors are greatly enhanced.

SUMMARY OF THE INVENTION

The devised method includes a step of electro etching of a part surface in an electrolyte bath of specific formulation and temperture. Under an applied electrical current, surface portions of the part are removed, with loosened and removed particles combining with oxygen in the bath to form nickel oxides. During a soaking period following discontinuance of the electrical current, in the same bath in which etching took place, the metal oxides are dissolved, leaving a clean, textured surface on the part. While the part is chemically clean and free of metallic oxides, it is rinsed and has electro deposited thereon a base of "strike" coat of a material compatible with the parent metal and the final plating material. Substantially pure nickel, for example, bonds effectively to the nickel alloy and provides a compatible base for a silver alloy. The "strike" coating achieves a close intimate contact with the textured part surface and penetrates recesses therein, interlocking therewith and providing for a secure attachment of the nickel plate to the part. Application of the silver plating or the like, in one of more steps, then is carried out, conditions having been established in the part preparation enabling an end product of uniform excellence. After-plating machining of the part, as for example drilling, milling or the like is effected without encountering or uncovering loose plating and unbonded areas which may allow the plate material to crack or to peel.

DESCRIPTION OF PREFERRED INVENTION FORM

In what may be regarded as a preferred practice of the invention method, a nickel alloy part to be plated is mechanically cleaned, brushed or otherwise treated to remove from its surface foreign material, welding burrs and the like. A typical part may be made of one of the trade-named nickel alloys, and by way of example reference may be made to a metallic sealing ring made of Inconel. The exemplary part, therefore, is composed of about 80% substantially pure nickel along with appreciable amounts of chromium and iron.

A bath of an electrolyte solution is prepared according to a formulation by which the bath is comprised of water and 40% to 50% by volume of concentrated sulfuric acid. The bath is heated to a temperature in a range of 140° F. to 150° F. and maintained at a temperature in that range. The nickel alloy part is suitably connected in an electrical circuit, and, along with an oppositely charged electrode is immersed in the prepared electrolytic bath. The electric circuit then is energized and is held energized over a period of time appropriate to the strength of the applied current and the kinds of materials involved. In the present instance, treating an Inconel metal part and using a current strength of about 100 Amps per square foot of surface area of the part, a period of time of about 2 minutes, is adquate to the intended purpose.

The direction of current flow is reversed to what is customary or normal to an electroplating operation. Thus, the immersed part becomes the anode and the direction of current flow is from the part outwardly into the bath.

An electroetch effect accordingly takes place wherein charged particles of nickel alloy escape from the surface of the part giving such surface a textured quality. At the same time, however, and particularly in view of the inherent release of oxygen occurring at the anode, oxygen combines with escaping nickel alloy particles to form nickel oxides. These are variously present in the electrolyte bath and appear in loosely adherent form on the part surface.

When the determined time of current application has elapsed, the electric power is shut off. The etched part is not then removed from the electrolyte solution, however, but is allowed to remain soaking in the bath for a further period of time during which the nickel oxides are dissolved. This time period may vary with other established conditions of treatment. In a bath of the strength and temperature set forth, a soaking time of four minutes following turning off of the electric currrent has been found to be sufficient.

After soaking, the part is removed from the electrolyte bath and upon examination will be found to present a surface free of metal oxides and textured with well defined recessed areas. In an appropriate rinsing or flushing operation, a removed part is cleansed of electrolyte solution and then subjected to electrodeposition in which a plating material, as for example a silver alloy, is applied to the part surface. This is a sequential process in which a chemically clean and rinsed part is placed in a "strike" bath to have deposited thereon a base layer of a material compatible with the metal of the parent part and with the plating metal. Thus, in the illustrative instance, in an appropriate electrolyte bath wherein the anode is a bar or the like of substantially pure nickel and the part is the cathode, current is applied in a direction reversely of that in which it is applied in the electroetch operation. Metallic particles flow from the anode to the cathode and form a metallic deposit on the part surface. Application of the current is continued for a period of time sufficient to coat the part to the desired thickness. The nickel coating achieves a close intimate contact with the part surface, and, due to the absence of metallic oxides on the part, such contact is uniform over the part surface. Moreover, recesses in the part surface are penetrated by the nickel material so that a complementary relationship exists between the part and the nickel "strike" coating interlocking the two together. The composition of the electrolyte bath for the "strike" coating may be any appropriate to nickel plating and the temperature of the bath may be in a conventional range, as on the order of 100° F. to 120° F. The strength of the current may be on the order of 100 Amps per square foot of part surface and the duration of the applied current on the order of 4 minutes.

A part having a close secure coating of nickel thereon may then be finish plated in any known and conventional manner, as for example by having "strike" and final coats of silver deposited thereon. The finished product is a well and uniformly plated article. Machining thereof can be effected without encountering weak or unbonded plating areas so that little or no potential exists for peeling or cracking of the plate material as a result of or incident to machining. The necessity of performing required machining operations before plating is avoided.

It will be recognized that the invention has multiple aspects of novelty and utility, most of which have been before discussed. It can be noted that in the electroetch process the various factors of bath composition and temperature, time and intensity of electric current application, and soaking time mutually contribute to the advantageous end results. The metal of the part is etched as a function of the applied electric current. The etched metal is oxidized during the current application and the bulk thereof is nickel oxide. During the soak portion of the process, the electrolyte solution dissolves all of the metal oxides, including the nickel oxides without, however, materially attacking the unetched material of the part. The nickel "strike" coating applied to the thoroughly cleaned and etched part surface effectively unites with and interlocks with the part and provides a secure base for application of the silver plate material.

It has been made evident that the invention method lends itself to certain modifications within broad outlines of invention teachings. These and other modifications as may occur to persons skilled in the art having this invention disclosure before them are regarded as being within the scope of the claimed invention.

What is claimed is:

1. A method of preparing a nickel alloy part for plating, including the steps of immersing the part in an electrolyte bath, connecting the part as the anode in an electric circuit which when energized causes current flow to take place from said part outward into the bath, energizing said circuit and establishing and maintaining said current flow for a period of time sufficient to etch the part surface, etched metal being oxidized during the period of current flow, discontinuing current flow and after the current flow has been discontinued allowing the part to remain soaking in the same said electrolyte bath for a period of time sufficient to dissolve formed metallic oxides, removing the part from said bath, and while said part is substantially free of metallic oxides depositing on the surface thereof a plating base material penetrating and interlocking with etched surface portions of said part.

2. A method according to claim 1, wherein said electrolyte bath is composed of water and 40% to 50% by volume of concentrated acid, the bath temperature being established and maintained in a range of 140° F. to 150° F.

3. A method according to claim 2, wherein the part is allowed to soak in said bath for a period of time on the order of 4 minutes after shutting off the electric current flow and before removing the part from the bath.

4. A method according to claim 2, wherein the electric current flow is maintained for a period of time on the order of 2 minutes.

5. A method according to claim 2, wherein the electric current flow is maintained for a period of time on the order of 2 minutes, and wherein the part is allowed to soak in said bath for a period of time on the order of 4 minutes after shutting off the electric current flow and before removing the part from the bath.

6. A method according to claim 2, wherein said concentrated acid is sulfuric acid.

7. A method according to claim 2, wherein said deposited base material is substantially pure nickel and is applied in an electrodepositing operation.

* * * * *